US006962463B2

(12) United States Patent
Chen

(10) Patent No.: US 6,962,463 B2
(45) Date of Patent: Nov. 8, 2005

(54) CONSTRUCTION OF ENVIRONMENTAL AND WATER-PERMEABLE PAVING

(76) Inventor: Jui Wen Chen, Room B, 10th Fl., No. 415, Chung Cheng Rd., Shu Lin City, Taipei Hsien (TW)

( * ) Notice: Subject to any disclaimer, the term of this patent is extended or adjusted under 35 U.S.C. 154(b) by 0 days.

(21) Appl. No.: 10/652,245

(22) Filed: Sep. 2, 2003

(65) Prior Publication Data

US 2005/0047866 A1 Mar. 3, 2005

(51) Int. Cl.[7] ..... E01C 7/00
(52) U.S. Cl. ..... 404/75; 404/72
(58) Field of Search ..... 404/2, 3, 17, 27, 404/28, 31, 70, 71, 72, 75; 405/50; 52/302.1, 414, 302.6, 576

(56) References Cited

U.S. PATENT DOCUMENTS

| | | | | | |
|---|---|---|---|---|---|
| 181,392 | A | * | 8/1876 | Baird | 404/70 |
| 687,106 | A | * | 11/1901 | Anderson | 404/3 |
| 2,148,773 | A | * | 2/1939 | Ozias | 404/2 |
| 2,192,369 | A | * | 3/1940 | Sparrow | 404/3 |
| 2,746,365 | A | * | 5/1956 | Darneille | 404/2 |
| 3,521,699 | A | * | 7/1970 | Huisen | 165/45 |
| 3,561,177 | A | * | 2/1971 | Agro et al. | 52/169.14 |
| 3,645,177 | A | * | 2/1972 | Hargett | 404/2 |
| 3,690,227 | A | * | 9/1972 | Welty et al. | 404/2 |
| 3,712,187 | A | * | 1/1973 | Stelling | 404/3 |
| 4,797,026 | A | * | 1/1989 | Webster | 404/28 |
| 4,852,319 | A | * | 8/1989 | Cowan | 52/302.1 |
| 5,123,778 | A | * | 6/1992 | Bohnhoff | 404/28 |
| 5,282,691 | A | * | 2/1994 | McIntosh et al. | 404/3 |
| 5,308,187 | A | * | 5/1994 | Nix | 404/17 |
| 5,466,092 | A | * | 11/1995 | Semenza et al. | 405/45 |
| 5,482,399 | A | * | 1/1996 | Bright et al. | 404/17 |
| 5,730,548 | A | * | 3/1998 | Brero et al. | 404/27 |
| 5,863,148 | A | * | 1/1999 | Shivaram | 404/28 |
| 6,585,449 | B2 | * | 7/2003 | Chen | 404/2 |
| 6,632,046 | B2 | * | 10/2003 | King et al. | 405/119 |

FOREIGN PATENT DOCUMENTS

| | | | |
|---|---|---|---|
| JP | 3-267405 | * | 11/1991 |

* cited by examiner

*Primary Examiner*—Gary S. Hartmann
(74) *Attorney, Agent, or Firm*—Leong C. Lei

(57) ABSTRACT

A method of constructing an environmental and water-permeable paving, which includes the steps of connecting a plurality of frame units composed of water ducts and connecting meshes to form a great area of framework; burying the frame units into the soil, above the macadam stratum; pouring concrete onto the frame units and having the concrete solidified to form a concrete board; and applying a asphalt and macadam stratum onto the concrete board or other paving to complete a water and air permeable paving. Drainage belts are provided under the water ducts in predetermined positions, such that the accumulated rain can be led to the underground and collected in the reservoirs. Concluded above, the paving constructed according to the invention is an environmental and water-permeable paving, which can automatically regulate the temperature of the roadways, as well as the temperature and humidity of the environment.

16 Claims, 18 Drawing Sheets

CONSTRUCTION OF ENVIRONMENTAL AND WATER-PERMEABLE PAVING

BACKGROUND OF THE INVENTION (a) Technical Field of the Invention

The present invention relates to a construction of an environmental and water-permeable paving, particularly to a construction which has the water ducts pre-buried under the ground, such that the rain on the ground can be led into the underground for supplementing the water of the soil and that the vaporized water can be released from the soil in hot weather to reduce the high temperature of the ground, as well as automatically regulate the temperature and humidity of the environment. Meanwhile, drainage belts can lead the permeating water to the reservoirs so as to avoid water from accumulating on the ground and obtain the purposes of water collection and recycle.

(b) Description of the Prior Art

The construction for an environmental and water-permeable paving of the prior art titled "Construction of an environmental and water-permeable concrete paving" under Application. No. 88110248 was disclosed by the inventor of the present invention and allowed patent.

Said prior art is characterized in that the processes include inserting and engaging the hollow water ducts with plugs into the frame units, disposing the frame units installed with the hollow water ducts on the pre-paved sand, pouring liquid concrete onto the frame units, and taking off the plugs from the water ducts after the concrete is solidified; thereby a paving which can lead the water into the sand stratum by way of the water ducts and drain the water to the underground for environmental-protection purposes.

Given that the paving of the above-mentioned prior art is formed by tiles made of concrete and paper moldboards, to further enhance the friction of the ground, reduce the noise generated by vehicles, and form an appearance of general roadway of asphalt, an asphalt and macadam stratum is preferably applied onto the concrete paving, as is the present invention.

In view of the above, the inventor strived for improvement of the prior art and developed a construction of an environmental and water-permeable paving, which can provide protection over water source.

SUMMARY OF THE INVENTION

The primary object of the present invention is to provide a construction of an environmental and water-permeable paving, which has substantially the same outer-appearance as general roadway, but has the function of draining away the water accumulated on the ground, thereby enhancing traffic safety. Meanwhile, the water led into the underground can enrich the water content of the soil and stored for recycle purposes.

The secondary object of the invention is to provide a construction of an environmental and water-permeable paving, which allows higher water content in the soil stratum, such that when the temperature raises, the water can be transmitted into vapor and released through the water ducts, thereby regulating the temperature and humidity of environment and avoiding heat island effect.

To obtain the above objects, the invention includes the steps of connecting a plurality of frame units composed of water ducts and connecting meshes to form a great area of framework; paving the frame units into the soil, above the macadam stratum; pouring concrete onto the frame units and having the concrete solidified to form a concrete board; and applying a asphalt and macadam stratum onto the concrete board or other paving to form a water and air permeable paving. Drainage belts are provided under the water ducts in predetermined positions, such that the rain can be led to the underground and collected in the reservoirs, thereby the paving constructed according to the invention is an environmental and water-permeable paving, which can allow the rain on the ground to permeate into the underground to avoid water from accumulating on the roadway. Meanwhile, the water collected underground can be recycled for further use.

BRIEF DESCRIPTIONS OF THE DRAWINGS

DETAILED DESCRIPTION OF THE EMBODIMENT

Figure 1:
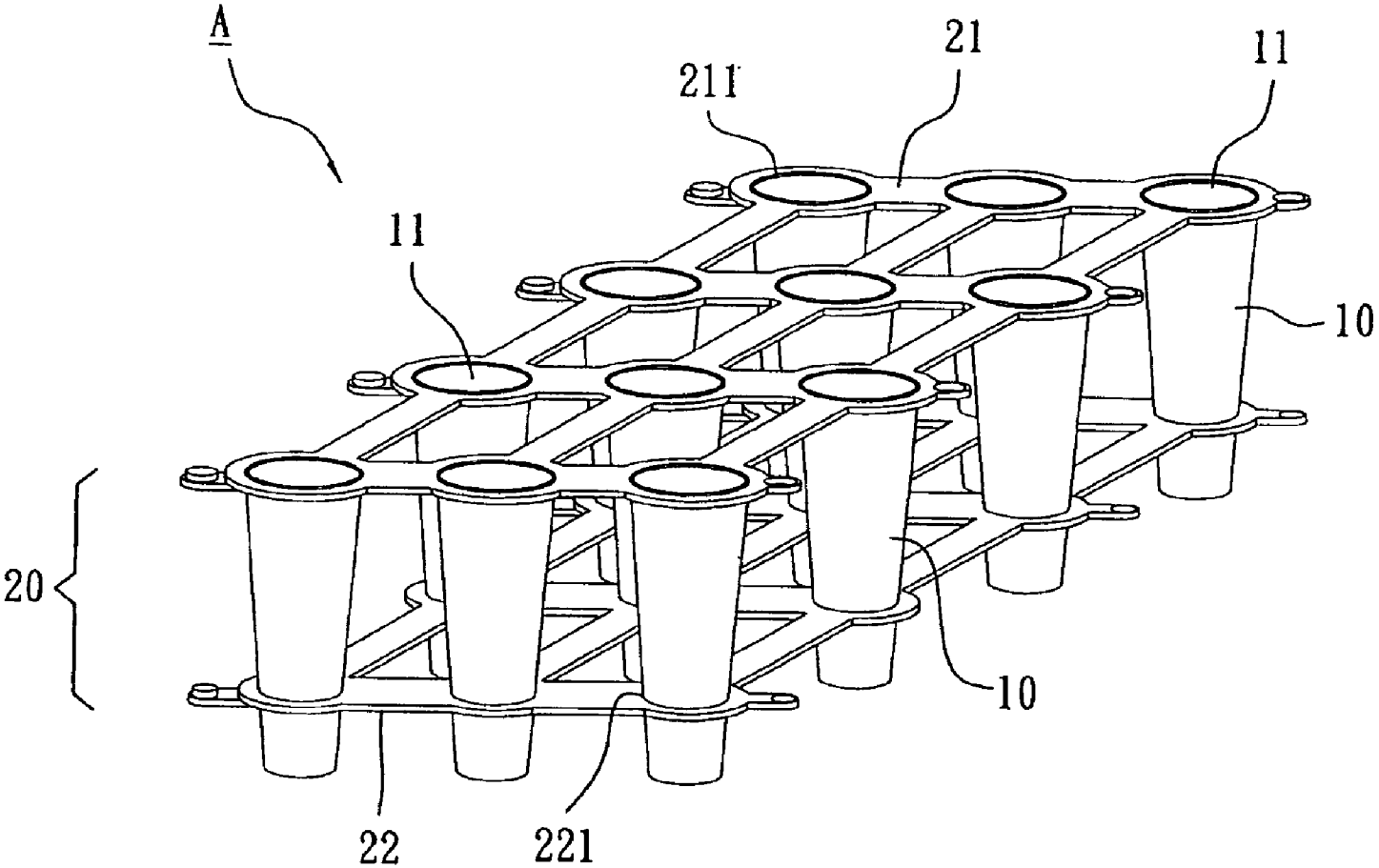
FIG. 1 is an exploded view of the frame units composed of water ducts and connecting meshes.

Referring to FIG. 1, the construction of an environmental and water-permeable paving according to the invention primarily adopts a frame unit A composed of a plurality of water ducts 10 and connecting meshes 20.

The water ducts 10 are preferably in the form of a through pipe with a wide pipe head 11 and a narrow bottom outlet such that the water ducts 10 can go through to and engage with the connecting meshes 20.

The connecting mesh 20 can be in the form of a single mesh or alternatively double mesh equipment. As shown, the double mesh equipment includes an upper connecting mesh 21 provided adjacent to the top water duct, and a lower connecting mesh 22 adjacent to the bottom water duct. In order to be adapted to the taper water ducts, the upper connecting meshes 21 have a greater bore diameter than that of the lower connecting meshes 22, such that water ducts 10 can be engaged in the holes 211, 221.

Nevertheless, if the water ducts 10 is not in the form of a taper, the upper and lower connecting meshes can have the same bore diameter for combining with the water ducts to form a frame unit. Note that even a single connecting mesh combines with a plurality of water ducts or pre-cast reinforcing steel bars (not shown) are provided in-between water ducts can form a basic frame unit A.

Besides, the water ducts 10 and the connecting meshes 20 are not necessarily made of plastic. Metal or the like can be used as well.

Figure 2:
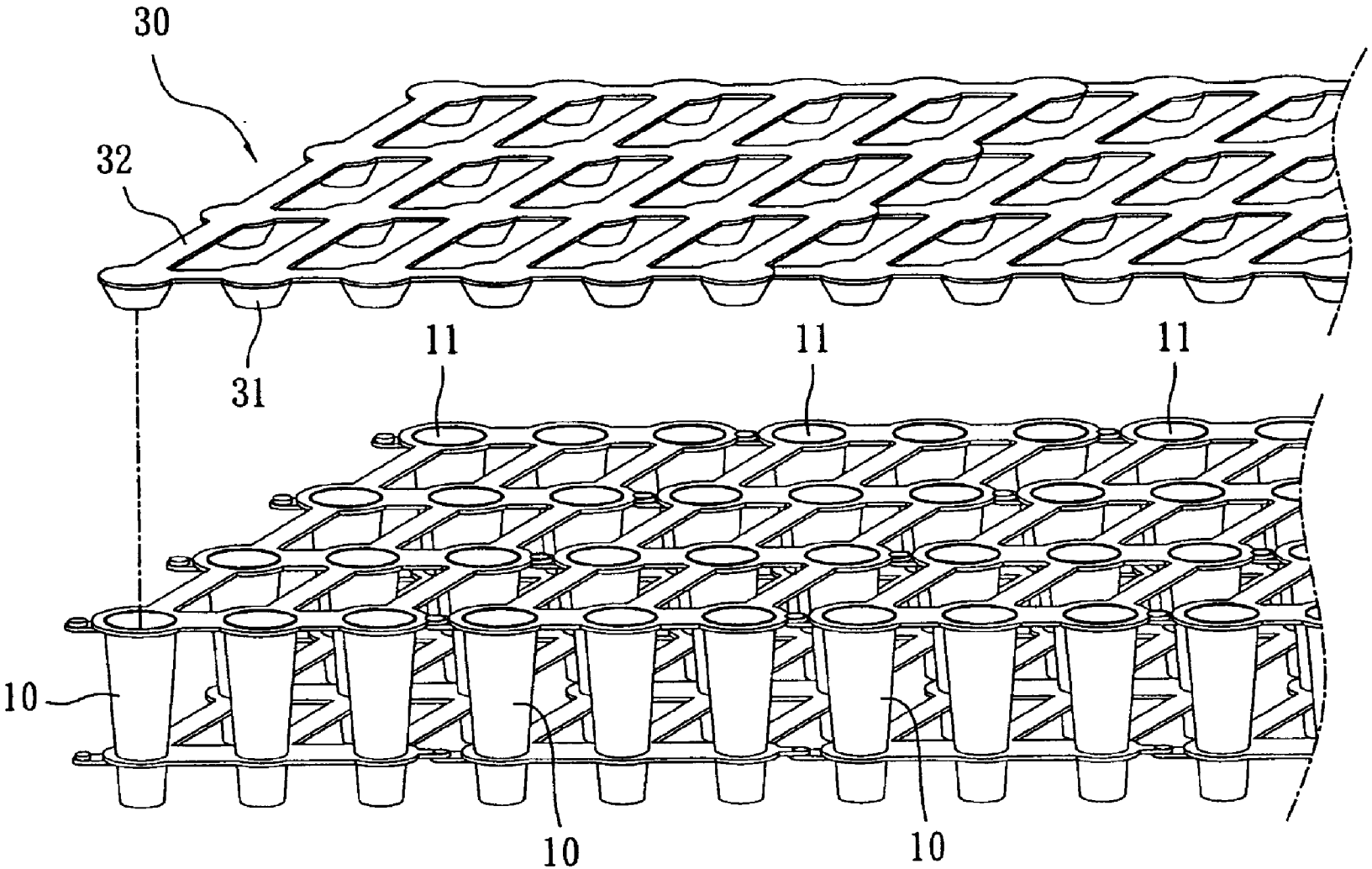
FIG. 2 shows that the frame units are to be mounted with covering meshes.

Referring to FIG. 2, when the frame units A are formed, a covering frame 30 can be covered on the pipe heads 11. To be time efficient, a plurality of plugs 31 connected by connecting strips 32 can be provided on the covering frame 30, thereby avoiding the water ducts from being stuck by the concrete at the time of grouting.

Figure 3:
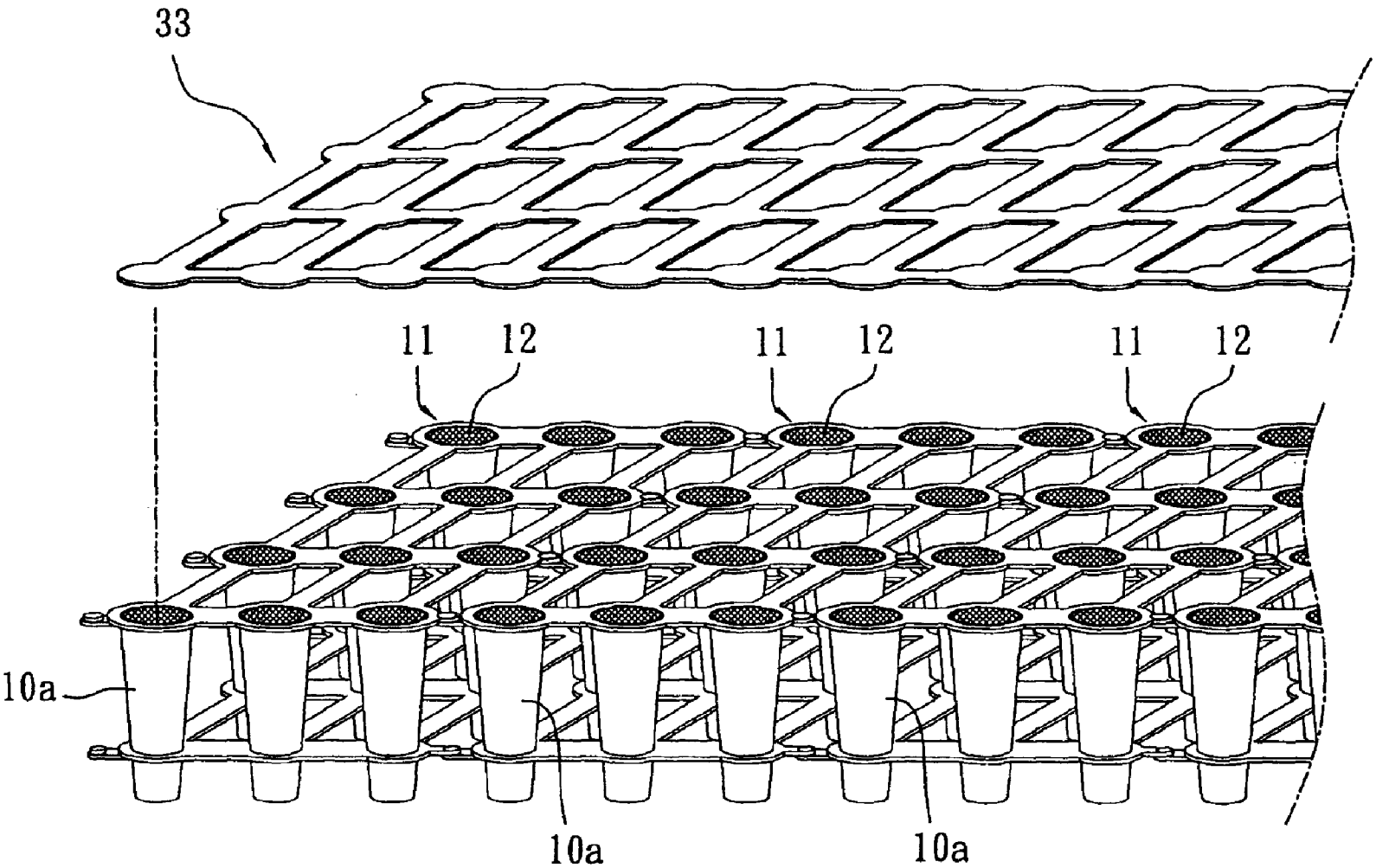
FIG. 3 shows that the frame units are integrally provided with nets and to be adhered with films.

Referring to FIG. 3, nets 12 can be integrally formed on the head 11 of water ducts 10*a* at the time of plastic injection. Films 33 can be further covered on the water ducts to avoid the concrete from entering into the water ducts at the time of grouting.

Figure 4:
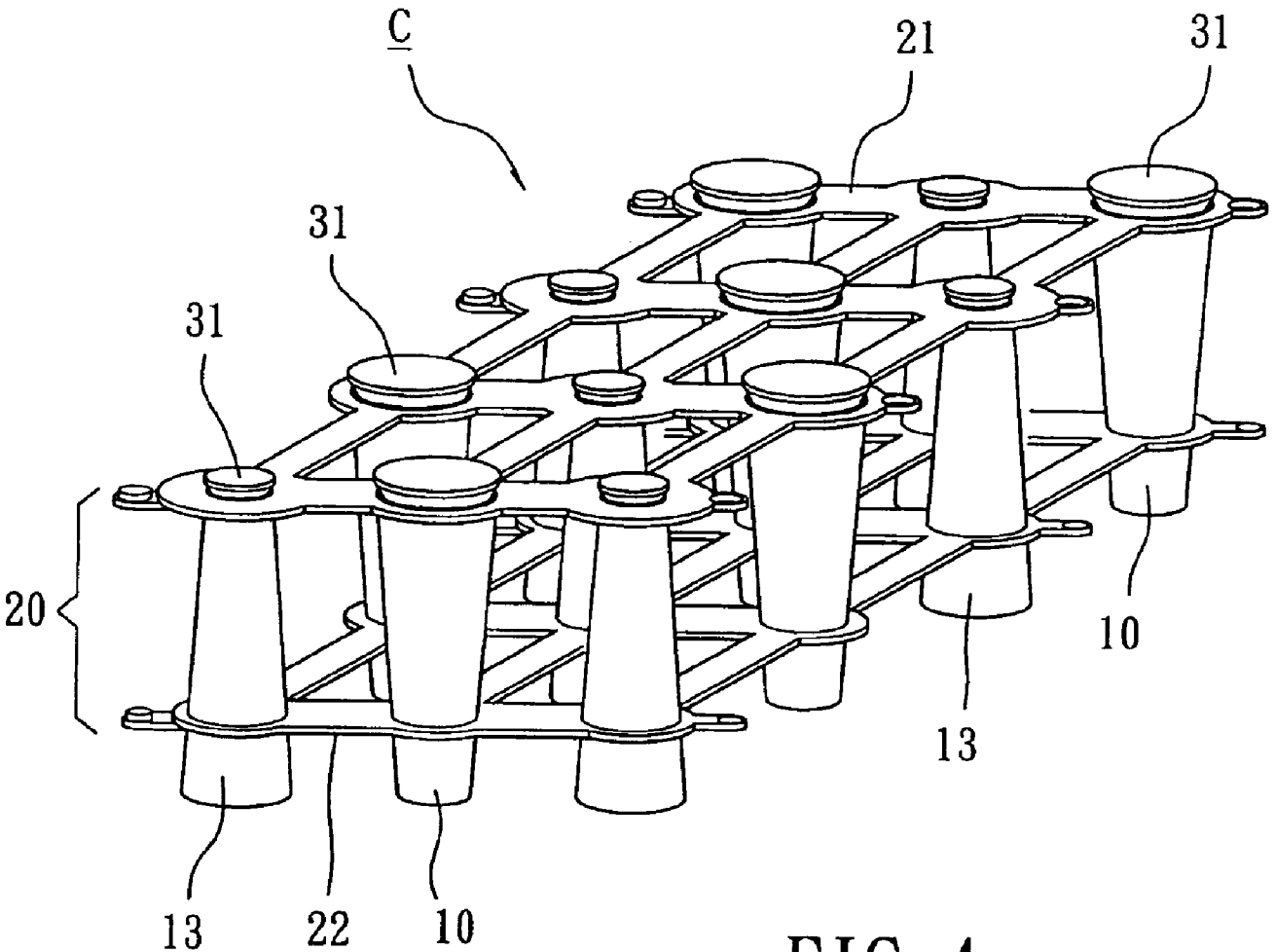
FIG. 4 is an exploded view of the frame units according to another embodiment of the invention.

Referring to FIG. 4, the frame unit C of another embodiment of the invention is composed of a plurality of water ducts 10 and ventilating pipes 13. While the water ducts 10 are vertically disposed in the form of a narrow bottom taper, the ventilating pipes 13 are vertically disposed in the form of wide bottom taper. Said water ducts and ventilating pipes are arranged in an alternate way, such that under the permeable paving, the water accumulated on the ground can be instantly led to the underground by way of the water ducts 10 in wide bottom taper form, and the vapor generated underground can be ventilated upwardly by way of the ventilating pipes 13 in the form of narrow bottom taper.

Figure 5:
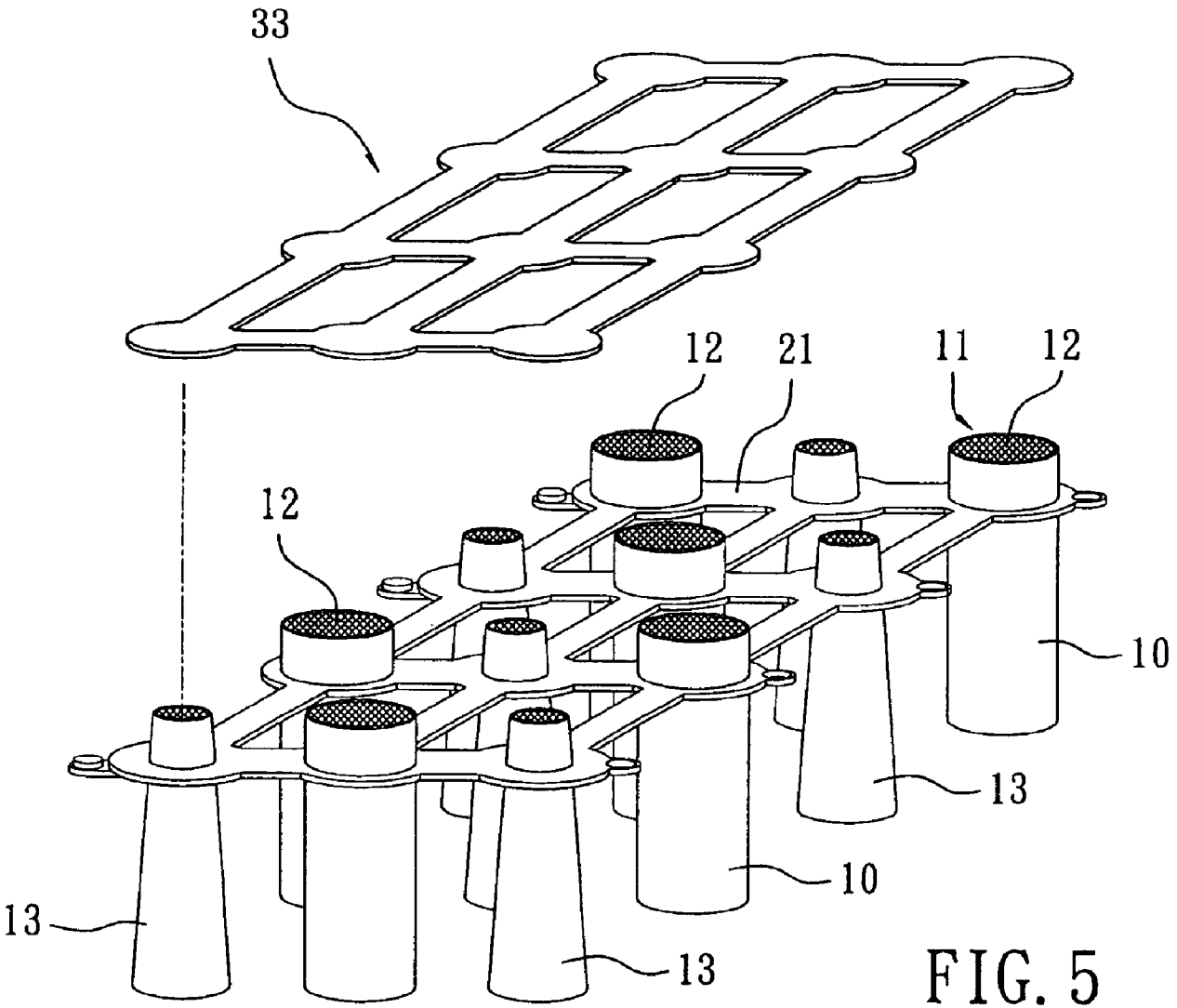
FIG. 5 is an exploded view of the frame units according to another embodiment of the invention.

Referring to FIG. 5, the frame unit D of another embodiment of the invention is composed of a plurality of water ducts 10, ventilating pipes 13 and upper connecting mesh 21 integrally formed by plastic injection. To ease detaching mold, the water ducts 10 can be made as a cylinder, whereas the ventilating pipes 13 remain in wide bottom shape. Besides, the integrally formed board can combine with upper connecting meshes 21, and the pipe head 11 of each water duct 10 and ventilating pipe 13 can be provided with a net 12, as shown in FIG. 3, and further covered by a film 33 to avoid liquid concrete from entering into the water ducts and pipes at the time grouting.

Figure 6:
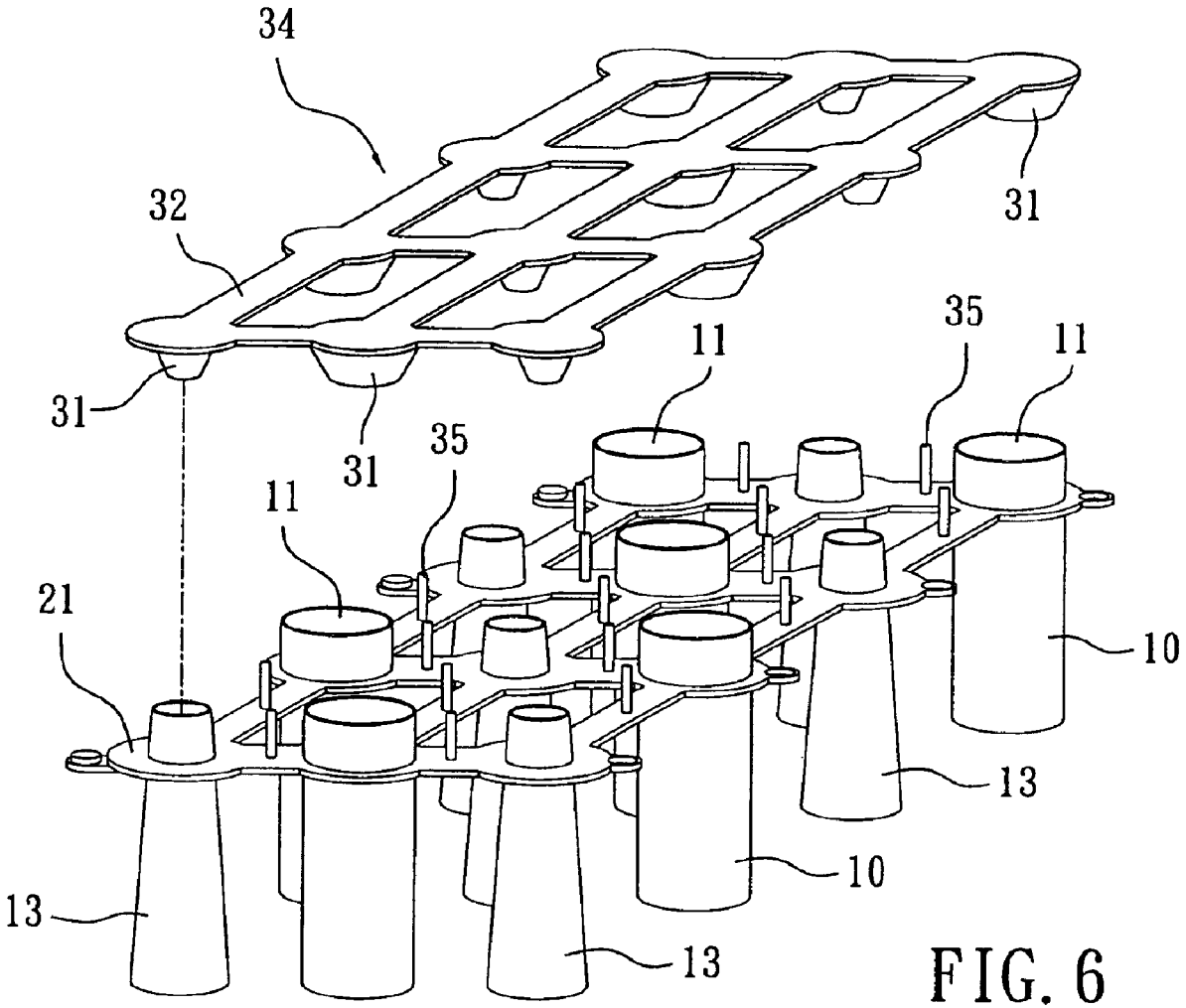
FIG. 6 is an exploded view of the frame units according to another embodiment of the invention.

Referring to FIG. 6, the water ducts 10, ventilating pipes 13 and upper connecting meshes 21 can be formed integrally. The pipe heads 11 are pre-covered by a covering frame 34 to avoid the liquid concrete from entering the pipes and sticking inside. As there pre-keeps a small distance between the upper connecting meshes 21 and pipe heads 11, to prevent the connecting mesh 21 board from falling down, supporting pillars 35 can be provided under the upper connecting mesh 21 board.

The wide bottom ventilating pipes 13 can allow the vapor generated by the humidified soil dispel from the underground (like a chimney), so as to automatically regulate the temperature and humidity of the atmosphere, i.e. heat exchange effect (like breathing), as well as reduce the temperature of the ground to avoid the roadway from becoming impermeable due to the asphalt's becoming softened by heat and the roadway's sagging day by day for being constantly run over by vehicle. Furthermore, the present invention not only can avoid the tires of the vehicle from being quickly worn due to the rubber's being heat-melted, but also can automatically regulate the temperature of the air to avoid heat island effect.

In addition, while the paving of the roadway can be made of asphalt macadam stratum 52, the water contained in the soil stratum can be vaporized and dispelled out to the ground by way of the connected ventilating pipes 13, which is actually a ventilating conduit in-between the atmosphere and the soil stratum. Although the vehicle run over the roadway persistently, the paving will recover after sagging, right as a compressor pump. The portion above the water ducts/ventilating pipes without being run over by the vehicle would automatically push out the moisture in the soil, and accomplish the purposes of regulating the temperature.

An estimated result for the influence of the environmental temperature to the roadway paving unveils that when in day time the temperature reaches 28° C. (under an estimated time over 150 hours), general concrete paving would be 2° C. higher than the atmosphere due to the constantly absorbing of the heat, and in the case of asphalt paving, the temperature thereof is even 10~30° C. higher than the atmosphere! The influence is quite astonishing! However, as the permeable paving according to the invention can automatically regulate the temperature of the underground, the estimated result shows that the temperature of the paving is even 5~7° C. lower than that of the atmosphere. At night, the temperature of the general concrete paving might almost be equal to that of the atmosphere if there is no rain. In the case of the invention, due to the release of the heat from the underground, the temperature of the paving would be 2~3° C. higher than that of the atmosphere. In view of the above, the paving according to the invention has the function of automatically regulating temperature to keep a "constant temperature", which is a very important contribution in avoidance of heat island effect and radio-cooling effect.

Figure 7:
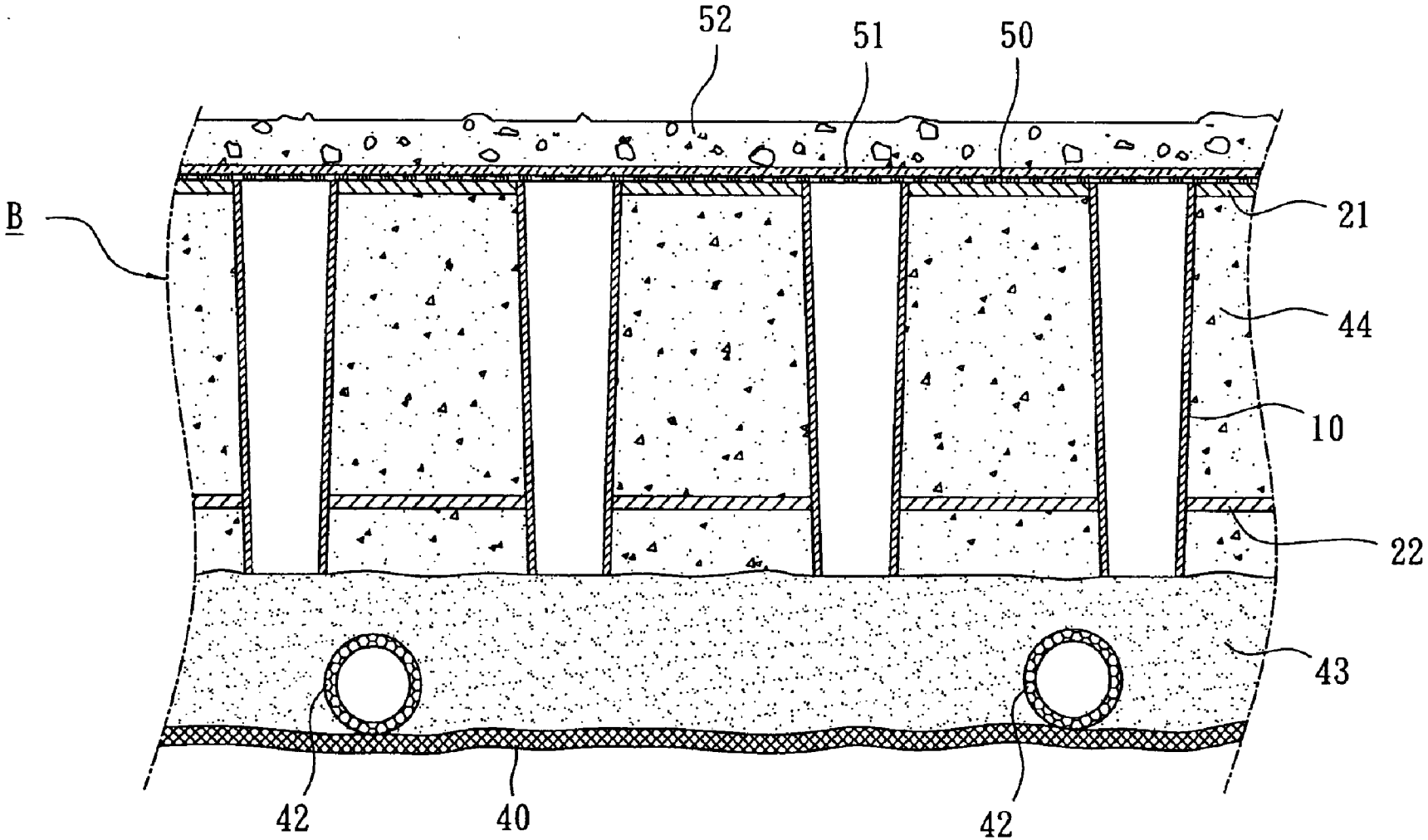
FIG. 7 is a cross-sectional view of the permeable paving according to the invention.
Figure 8:
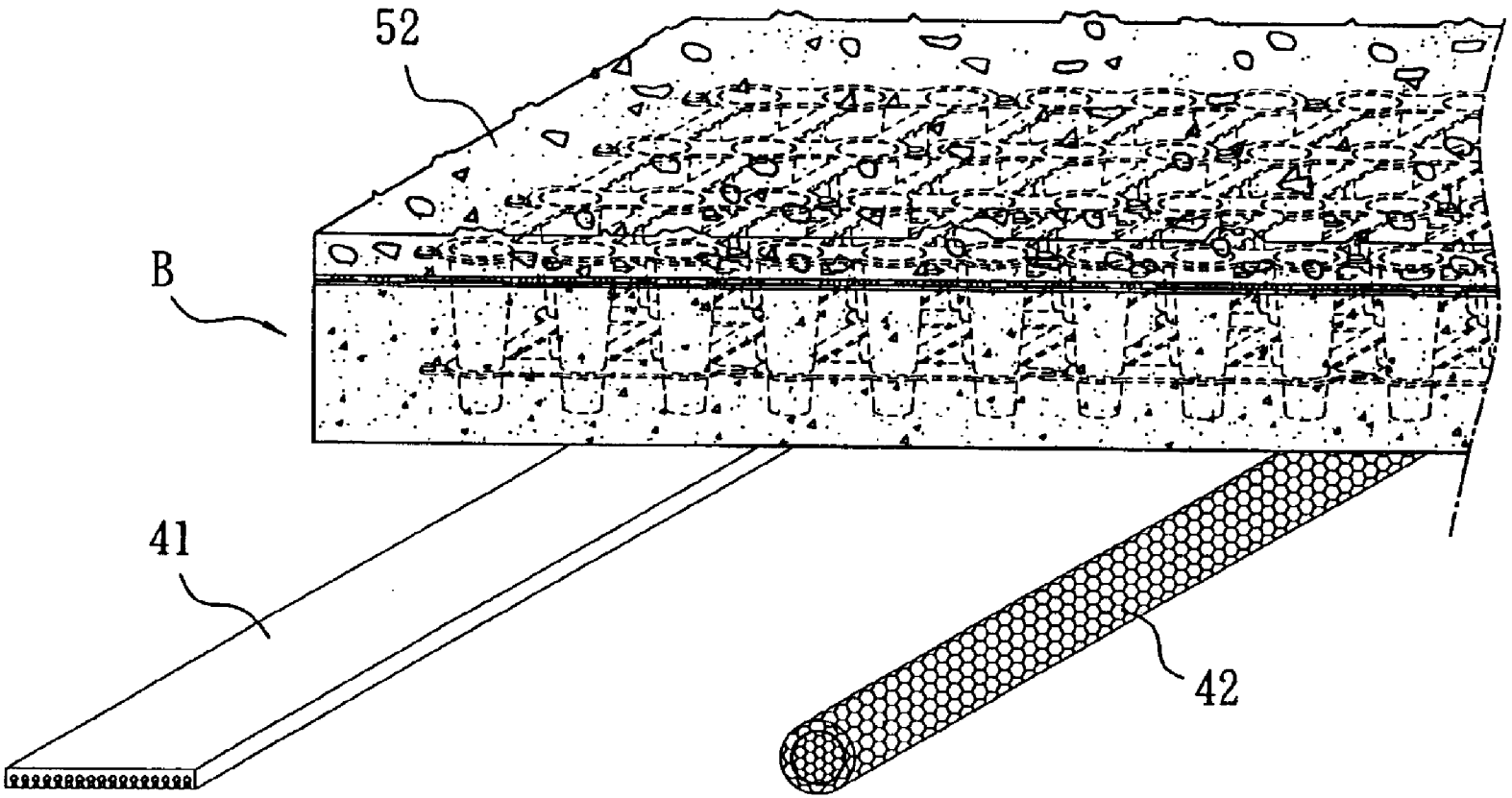
FIG. 8 shows that drainage belts and drainpipes are pre-buried under the permeable paving.

Referring to FIGS. 7 and 8, before paving, the roadway can be leveled by mechanism and pre-paved by a waterproof cloth 40 (as shown in FIG. 7). (p.s. This can be conducted pending the need in specific roadways.) Drainage belts 41 (as shown in FIG. 8) and/or drainpipes 42 (as shown in FIGS. 7 and 8) can be installed in pre-determined distance. (p.s. The installation of said drainage belts and drainpipes can depend on the need in specific roadways.) The drainage belts and drainpipes can be covered by soil 43 to form a stratum. (p.s. Said soil stratum can be further paved with macadam, pebbles, coarse sand or the like permeable materials.)

After the formation of frame units A, liquid concrete can be poured onto the frame units A. Reinforcing steel bars (not shown) can be added before grouting, if necessary.

Figure 9:
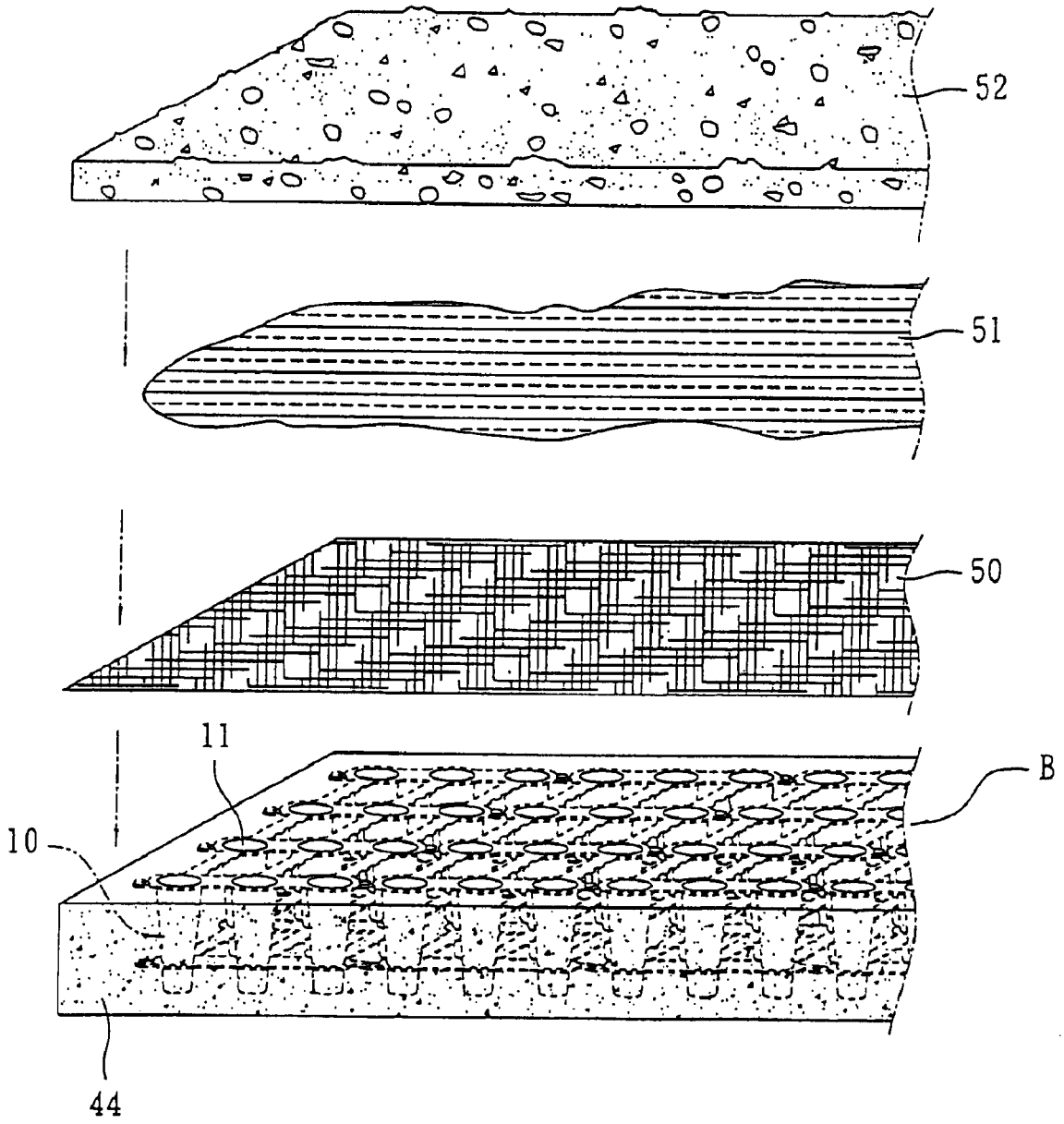
FIG. 9 is an exploded view of the permeable paving structures.
Figure 10:
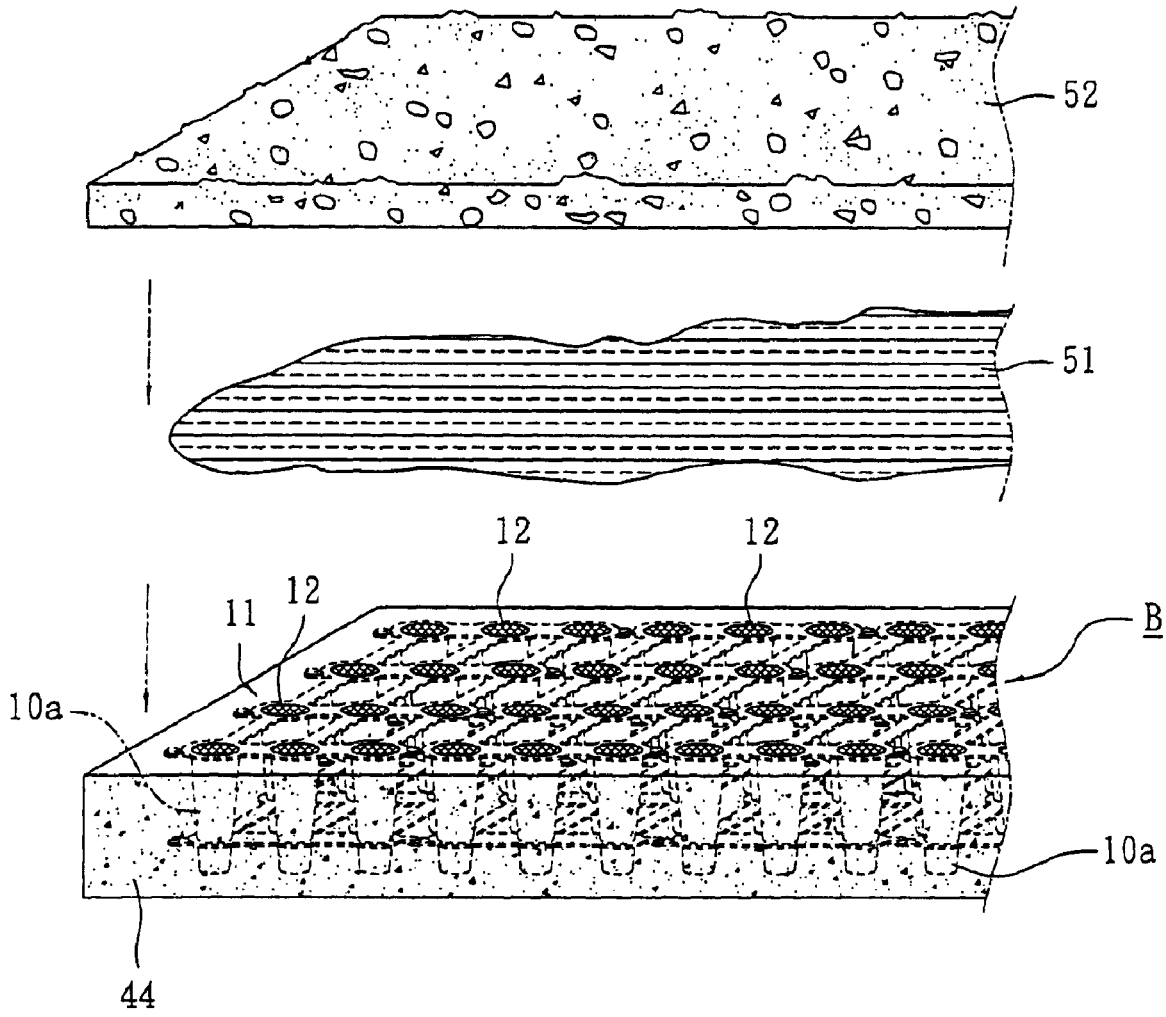
FIG. 10 is an exploded view of the permeable paving structures according to another embodiment of the invention.

Referring to FIGS. 9 and 10, after the concrete board B is formed, a layer of permeable screen mesh 50 can cover on the concrete board B to avoid the water ducts 10 from being stuck. A layer of asphalt is paved on the screen mesh 50 to serve as an adhesive before paving with an asphalt and macadam stratum 52, thereby the surface of the construction would just look general roadway. Note that said asphalt and macadam stratum 52 can be permeable or impermeable materials, which, in addition to macadam, can be added with environmental construction materials such as waste glass granules, PU granules recycled from waste tire (for soft paving), or colored pebbles, etc.

The permeable screen mesh 50 according to the invention can be a layer of non-woven fabric or a fiber fabric and can cover the water ducts 11 to screen pebbles or sand from falling into the water ducts 11 and stuck inside.

The screen meshes 50 can be alternatively substituted by the other screening devices such as foam materials, only if they can cover the water duct heads 11 for avoiding jam during further process.

Referring to FIG. 10, after completion of the process of the water ducts 10*a*, as shown in FIG. 3, each water duct 10*a* is provided with a net 12 on its top for filtering purposes, thereby sparing the step of adhering screening mesh 50. Asphalt 51 can be applied to the water ducts 10*a*, and subsequently an asphalt and macadam stratum 52.

Figure 11:
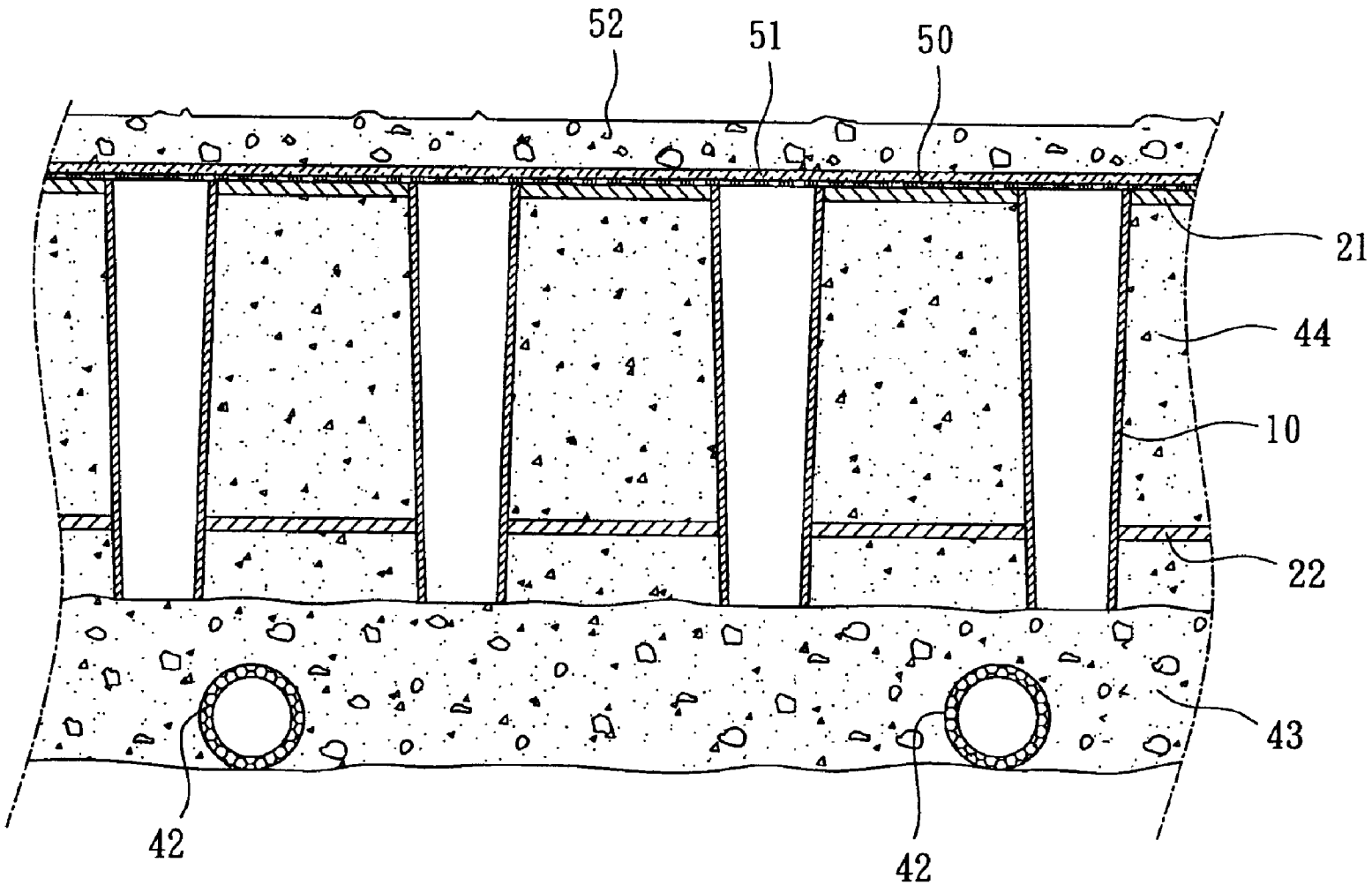
FIG. 11 is a cross-sectional view of the permeable paving according to another embodiment of the invention.

Meanwhile, the afore-mentioned waterproof cloth 40 can be applied depending on the need of specific roadways. For example, in case a section of roadway need be appropriately supplemented with water (rain), said water-proof cloth 40 can be spared (as shown in FIG. 11), sectionally provided or hollowed out evenly, such that the water accumulated on the ground can be led into the soil to enhance the water content and, in turn, assist the growth of the roadside plants.

Figure 13:
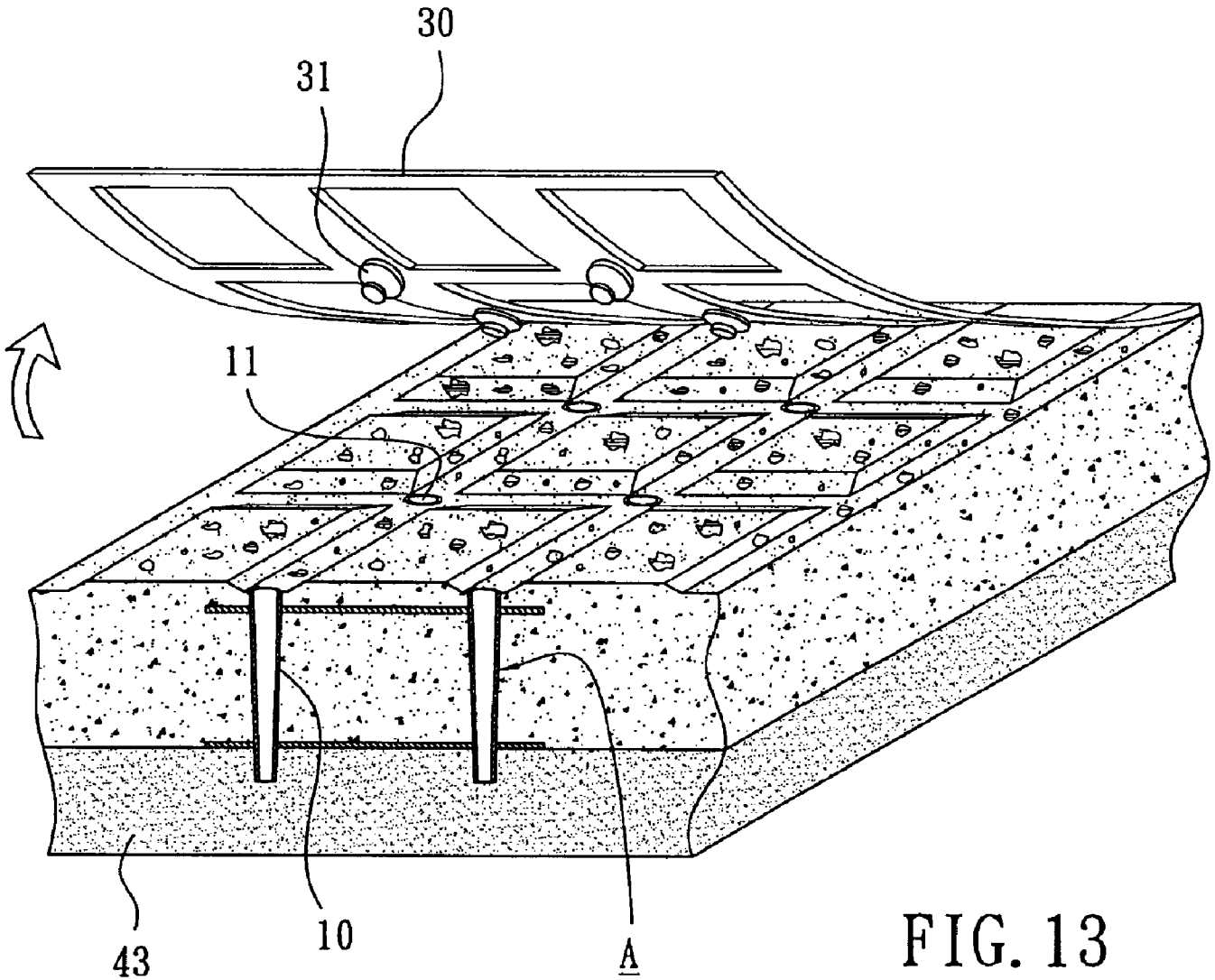
FIG. 13 shows the pre-cast connecting strips with plugs.

Referring to FIG. 13, the aforementioned frame units A are disposed in the soil 43. Preferably, the water outlet at the bottom of the water duct 10 is buried in the soil stratum. After the liquid concrete is poured onto the frame units A and solidified into a concrete board 44, the covering frame 30 on the pipe heads 11 can be removed along with the plugs 31 attached thereto, such that the pipe heads 11 of the water ducts can show.

Figure 14:
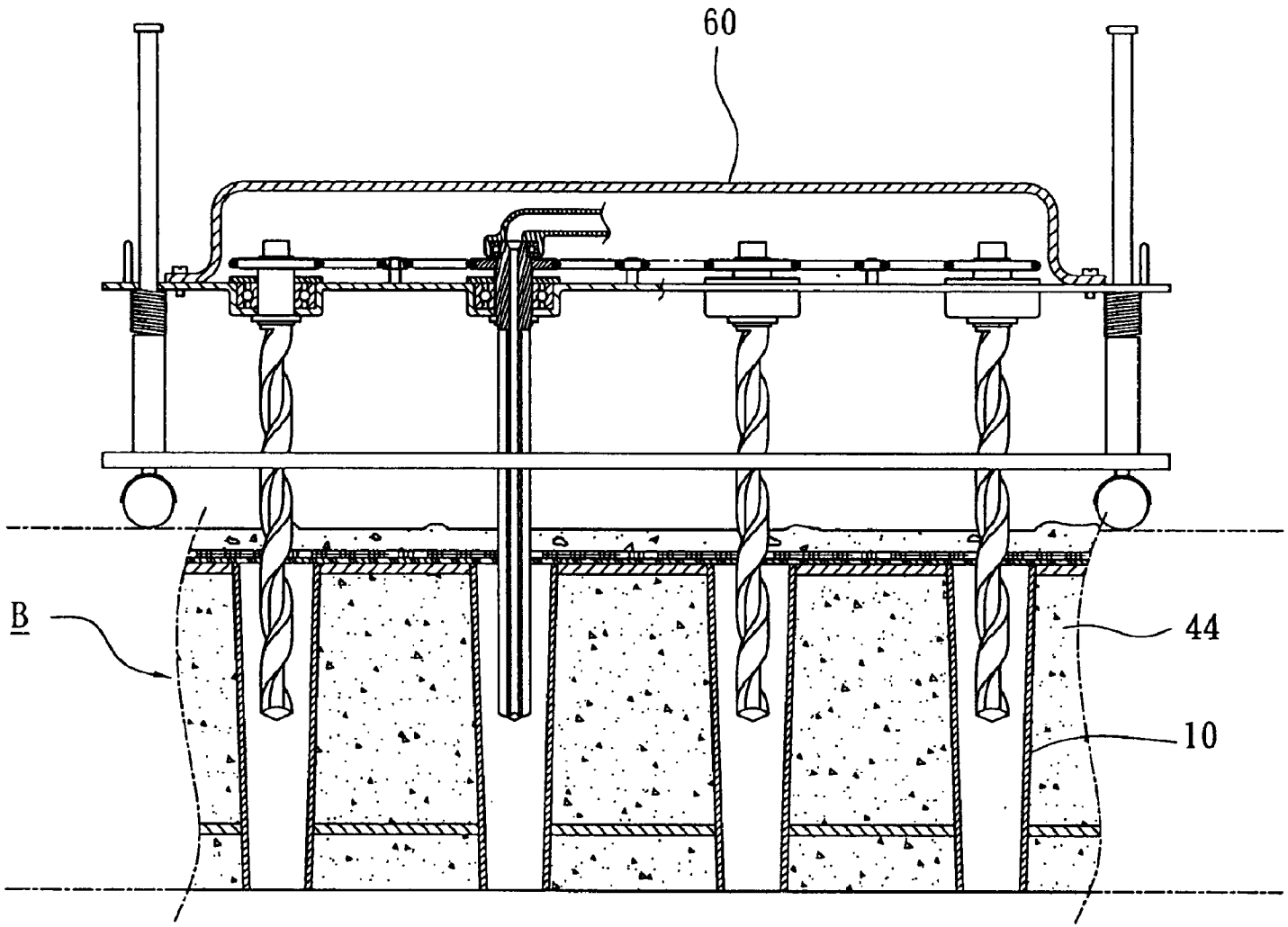
FIG. 14 shows that drilling equipment is drilling through the ground to form permeable holes.

As shown in FIG. 14, when the board B is of impermeable material, drilling equipment 60 can be used in drilling through the board B to make permeable bore holes. However, the application of the drilling equipment 60 is rather appropriate to those small roadways. In case the freeways in great square measure, it would more appropriate to directly use a paving of permeable asphalt with macadam.

When combining the board B with permeable screen meshes 50 of non-woven (or fiber) fabric, and further applying asphalt and macadam stratum 52 thereto, the maintenance of the roadways paved according to the invention would be much easier. Besides, if the quality of the construction reaches the standard, maintenance or mending of the roadways needs only be done on some specific portion or distance. By way of an asphalt-cutting machine, the screen meshes 50 under the paving are cut, thereby the screen meshes 50 along with the asphalt and macadam stratum thereabove can be integrally rolled up and removed. Non-woven or fiber fabric in an appropriate size can be simply applied to the ground and subsequently an asphalt and macadam layer 51 is applied to accomplish the mending of roadways, which, being durable, would not have pitch shortly and is smoothly connected to those not mended.

The mending or maintenance of roadway can be processed by rolling up the asphalt and macadam stratum 52 along with the screen meshes 50, directly applying a layer of asphalt 51 onto the concrete board B or the screen meshes 50, and then leveling the surface of the asphalt and macadam stratum 52 to complete the work.

Figure 15:
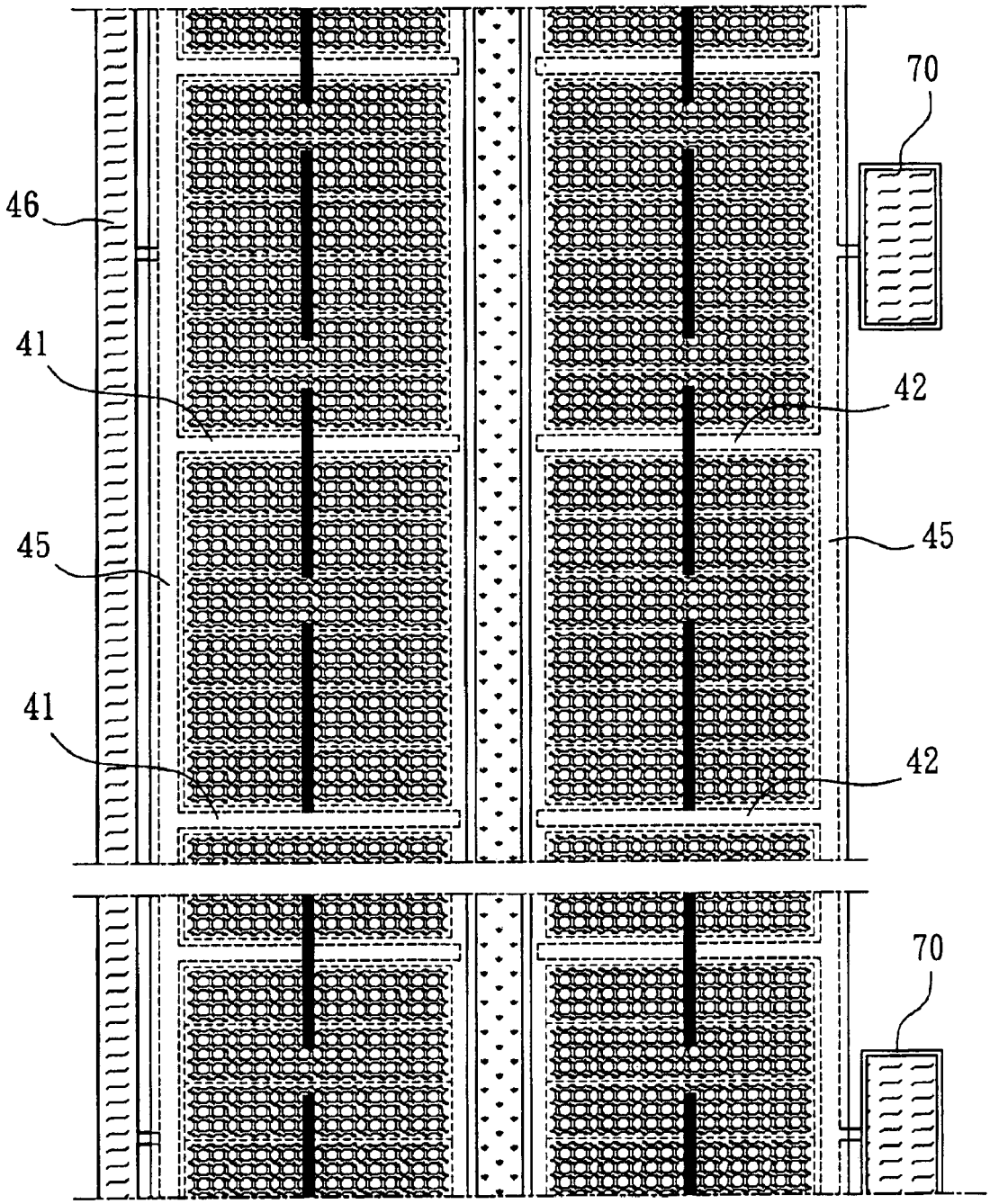
FIG. 15 shows an application of the invention.

As shown in FIG. 15, when constructing the permeable paving according to the invention, drainage belts 41 or drainpipes 42 (as shown in FIGS. 7 and 8) can be provided under the ground before being covered by soil 43 to form a stratum. In the case of applying drainage belts, water ducts 45 can be provided under the positions where the shoulder ways are. Given the provision of water-proof cloth, the great amount of rain permeated from the ground can be absorbed and drained away by the drainage belts, so as to avoid the roadways from sagging into the soft soil due to the overly contained water in the soil. The water absorbed and drained away by the drainage belts 41 can be collected by the water ducts 45 and led to the pre-buried reservoirs 70. In the above application, the following points should be noted:

1. It is recommended that a 30cm overburden be preserved when considering the depth of burying the drainage belts.
2. To enhance the water collection, a 5cm coarse sand stratum can be paved under the drainage belts.

The rain led by the water ducts 45 can be led to an escape cannel 46 to drain away in case of surplus.

Figure 16:
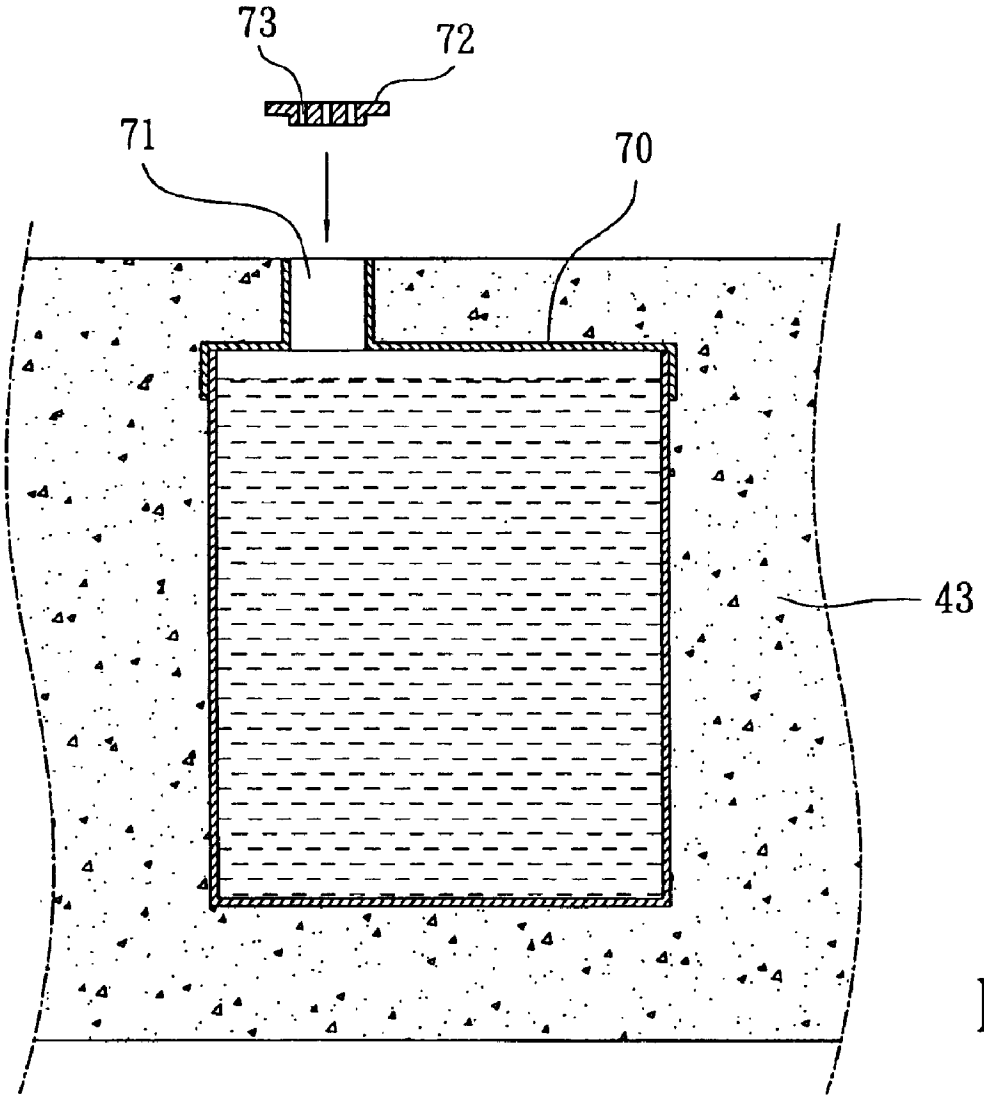
FIG. 16 shows an example of the reservoir according to the invention.

Referring to FIG. 16, the construction of the reservoirs 70 according to the invention can receive the rain led and collected by the water ducts 45 for storage. Basically, each reservoir 70 has an outlet 71 on the top and a cover 72 for the outlet 71. Ventilating holes 73 are provided on the cover 72 such that the air can be exhausted out when the water enters. The water stored in the reservoirs can be pumped out for the need of washing the roadways or flowering.

Figure 12:
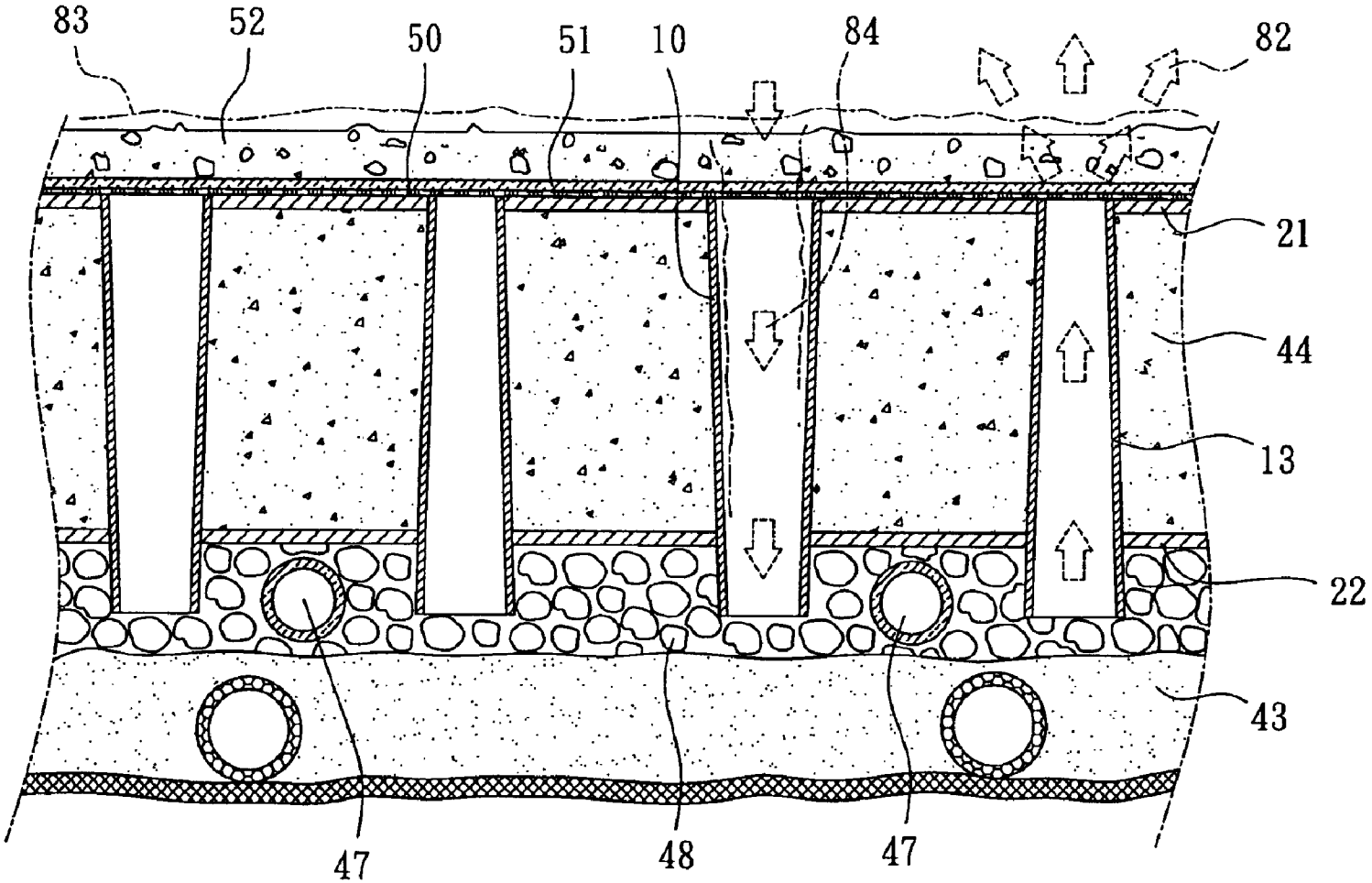
FIG. 12 is a cross-sectional view of the permeable paving according to another embodiment of the invention.
Figure 17:
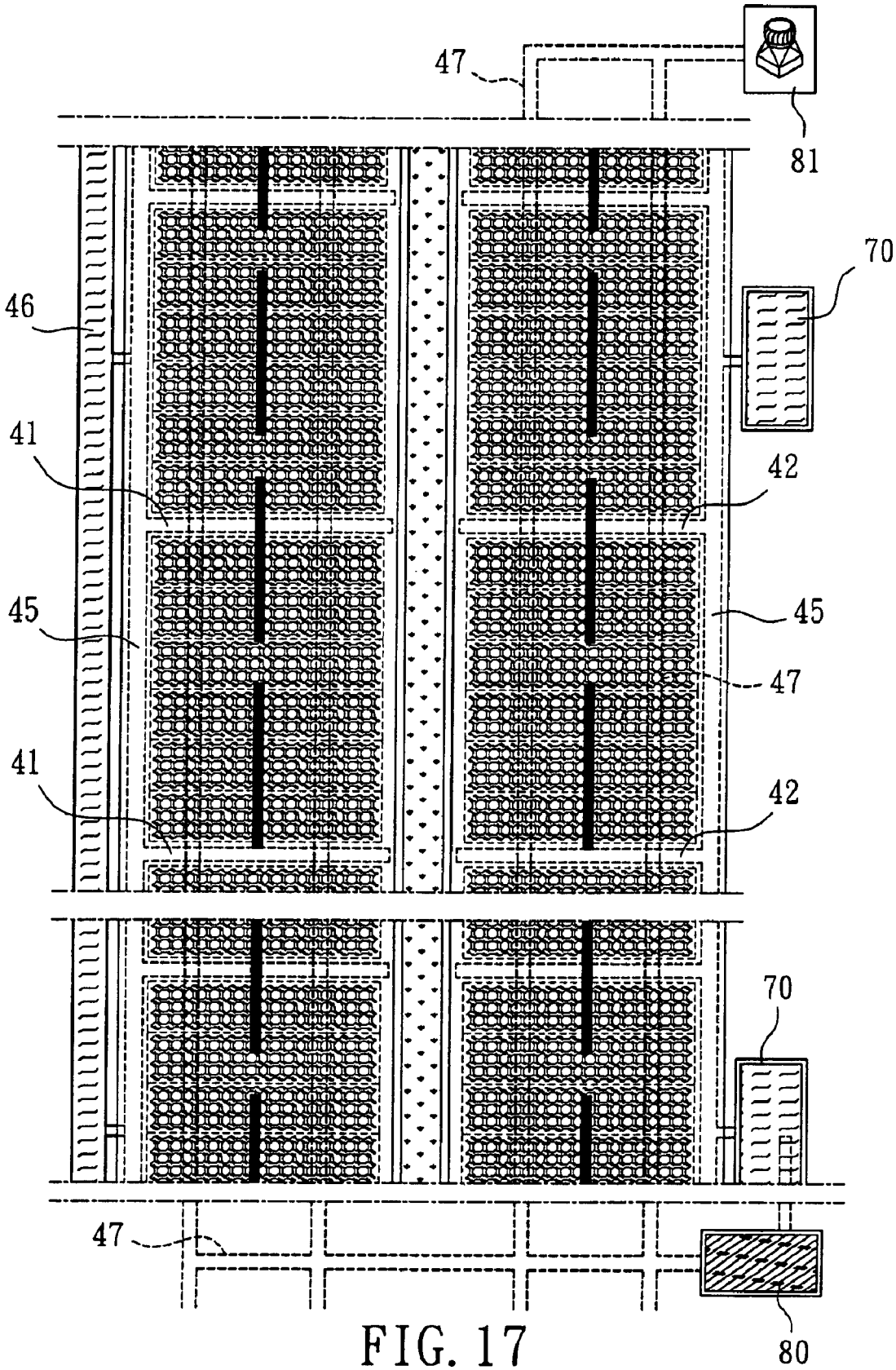
FIG. 17 shows another application of the invention.

Further referring to FIGS. 12 and 17, another embodiment of the environmental and water permeable paving according to the invention can be applied to the frozen roadways for speeding up ice-removing. The frame unit is composed of a plurality of water ducts 10 and ventilating pipes 13. When constructing the permeable paving, a plurality of steam pipes 47 are further provided in the macadam stratum 48 under the frame units (as shown in FIG. 12). A heater 80 generated by general power or solar power is connected to the reservoirs 70 at one end of the steam pipes 47, whereas a negative pressure equipment 81 is provided at the other end of the steam pipes 47. The power of said negative pressure equipment 81 can be general power, solar power, wind, etc. By way of the negative pressure generated by exhausting fans, the steam and heat 82 (as pointed by the arrows in FIG. 12) generated by the heater 80 can be led by the steam pipes 47, being a wide bottom taper shape, through the macadam stratum 48 to the permeable asphalt macadam paving 52, thereby speeding the melt of the ice 83 on the roadways. The water 84 (as pointed by the arrows in FIG. 12) from the melting ice can be led to the macadam stratum 48 by the water ducts 10, thereby preventing traffic accidents.

Figure 18:
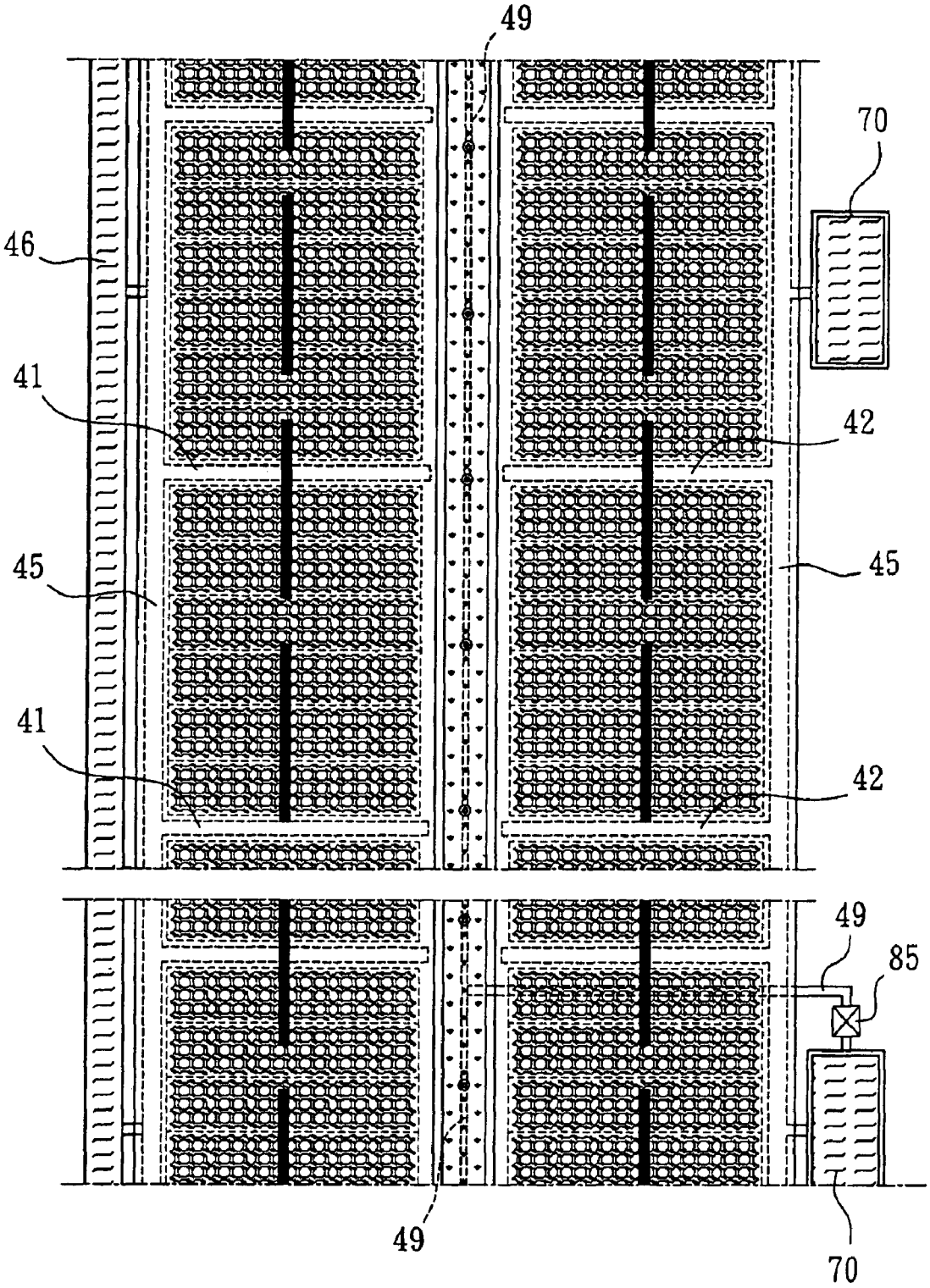
FIG. 18 shows yet another application of the invention.

Referring to FIG. 18, another embodiment of the environmental and water permeable paving according to the invention can be applied to the automation system of road washing and flowering. While under the periphery of permeable paving is provided with reservoirs 70 for collecting rain, automatic time sprinklers 85 and piping 49 can be provided to pump water from the reservoirs 70 at fixed times and amount for flowering purposes. The care of roadside plants may therefore become easier and automatized.

In view of the above, the present invention, after completing the construction, can achieve the following advantages:

1. The construction of the environmental and water-permeable paving is very time-and-cost efficient.

2. By way of the construction of the highly permeable paving, the water accumulated on the ground can be led into the underground and absorbed by the soil and macadam stratums, and the rest being stored or drained away by the drainage system.

3. The invention can alternatively be a semi-rigid paving, since the frame units combined with concrete can efficiently avoid the roadway from being worn due to over load-bearing. Besides, the permeable asphalt applied onto the concrete can further obtain a lasting and durable effect.

4. As the permeable asphalt used in the invention can instantly drain away the water accumulated on the ground, the mist can be efficiently reduced to avoid traffic accidents. Besides, the drainage belts and drainpipes provided in the frame units not only can replace the conventional reinforced steel bar to avoid concrete from cracking, but also can recycle the rain for further use.

5. The environmental and water-permeable paving according to the invention can allow rain recycled for further use by way of a heater, which can be generated by general power, solar power, wind power, etc., accompanied by negative pressure equipment and steam pipes, such that the ice piled up on the ground can be shortly melted into water, avoiding traffic accidents.

6. The environmental and water-permeable paving is provided with reservoirs for collecting rain for recycle purposes. The reservoirs accompanied with the time sprinklers and piping can proceed with flowering the roadside plants, as so to make the planting easier and automaticized.

7. The invention adapts dynamic theory and natural phenomena, wherein the frame units are poured with permeable asphalt and macadam paving to present a floor load bearing. While permeable asphalt and macadam is used as paving, it is much more comfortable and quiet than concrete paving which is rather rigid. Besides, the macadam stratum provided under the concrete can serve the purposes of air conditioning and drainage. When the great amount of rain is recycled, through the chimney effect of the air conditioning stratum, the collected rain can be released to the roadways in dry days by way of ventilating pipes, allowing the asphalt and macadam paving reduce its temperature, and avoid the generation of heat island effect and greenhouse effect, and efficiently solve the warming issue of the Globe and lasting the life of the earth.

Concluded above, the present invention discloses an environmental and water-permeable paving, which includes water ducts and concrete pre-cast to form permeable paving. In addition, screen meshes and permeable asphalt and macadam stratum are provided on the paving, such that the integral paving constructed according to the invention is environmental and water-permeable. In view of the novelty and environmental concept embraced by the present invention, as well as the value applicable to the filed, the inventor claims the invention as specified in the following claims.

I claim:

1. A method of constructing an environment and water-permeable paving comprising steps of:

(a) connecting a plurality of frame units composed of water ducts and connecting meshes to form a great area of framework;

(b) burying the frame units into soil, above a macadam stratum;

(c) jouring liquid concrete onto the frame units and having the concrete solidified to form a concrete board; and (d) applying an asphalt and macadam stratum onto the concrete board.

2. The method of constructing an environmental and water-permeable paving according to claim 1, wherein the water ducts used in step (a) are provided with nets on pipe heads.

3. The method of constructing an environmental and water-permeable paving according to claim 1, wherein around the frame units used in step (b) is constructed with reinforcing steel bars before pouring the liquid concrete thereonto in order to reinforce solidification of the concrete into a board.

4. The method of constructing an environmental and water-permeable paving according to claim 1, wherein before processing step (c), permeable screen meshes made of non-woven fabric or fiber fabric is paved on the concrete board.

5. The method of constructing an environmental and water-permeable paving according to claim 1, wherein before processing step (d), an asphalt is applied onto the concrete board.

6. The method of constructing an environmental and water-permeable paving according to claim 1, wherein drainage belts are provided under the water ducts in predetermined positions, such that rain is led to underground and collected in reservoirs for recycling.

7. The method of constructing an environmental and water-permeable paving according to claim 6, wherein water-proof cloth is provided beneath the drainage belts.

8. The method of constructing an environmental and water-permeable paving according to claim 1, wherein the frame units are composed of water ducts, ventilating pipes and connecting meshes.

9. The method of constructing an environmental and water-permeable paving according to claim 8, wherein the ventilating pipes have a narrow top and a wide bottom.

10. The method of constructing an environmental and water-permeable paving according to claim 1, wherein when constructing the water-permeable paving, a plurality of steam pipes are provided in the macadam stratum beneath the frame units, thereby snow accumulated on ground is melted by heat generated by a heater connected to the steam pipes.

11. The method of constructing an environmental and water-permeable paving according to claim 10, wherein a negative pressure device is provided at one end of a circuit of the steam pipes.

12. The method of constructing an environmental and water-permeable paving according to claim 8, wherein when constructing the water-permeable paving, time sprinklers and relevant piping are installed in the macadam stratum under the frame units for purposes of washing roadways and watering roadside plants.

13. The method of constructing an environmental and water-permeable paving according to claim 8, wherein the frame units are made integrally with the water ducts, ventilating pipes and connecting meshes.

14. The method of constructing an environmental and water-permeable paving according to claim 2, wherein before pouring the liquid concrete onto the frame units, the water ducts are adhered with plugs at the pipe heads to avoid the liquid concrete from entering into the water ducts.

15. The method of constructing an environmental and water-permeable paving according to claim 8, wherein supporting pillars are provided on an upper surface of the connecting meshes.

16. The method of constructing an environmental and water-permeable paving according to claim 8, wherein the water ducts and the connecting meshes are made of metal materials.

* * * * *